US009272316B2

(12) United States Patent
Claerhout

(10) Patent No.: US 9,272,316 B2
(45) Date of Patent: Mar. 1, 2016

(54) AXIAL ALIGNMENT APPARATUS AND METHOD FOR MAINTAINING CONCENTRICITY BETWEEN A SLOTTED TUBULAR AND A SEAMER HEAD

(71) Applicant: REGENT TECHNOLOGIES LTD., Nisku (CA)

(72) Inventor: Mike Claerhout, Nisku (CA)

(73) Assignee: RGL Reservoir Management Inc, Nisku (CA)

( * ) Notice: Subject to any disclaimer, the term of this patent is extended or adjusted under 35 U.S.C. 154(b) by 0 days.

(21) Appl. No.: 14/380,715

(22) PCT Filed: May 20, 2014

(86) PCT No.: PCT/CA2014/000434
§ 371 (c)(1),
(2) Date: Aug. 23, 2014

(87) PCT Pub. No.: WO2014/186865
PCT Pub. Date: Nov. 27, 2014

(65) Prior Publication Data

US 2015/0273551 A1 Oct. 1, 2015

Related U.S. Application Data

(60) Provisional application No. 61/827,543, filed on May 24, 2013.

(51) Int. Cl.
*B21C 31/00* (2006.01)
*B21C 37/30* (2006.01)

(52) U.S. Cl.
CPC ..... *B21C 31/00* (2013.01); *B21C 37/30* (2013.01)

(58) Field of Classification Search
CPC ..... B21D 22/14; B21D 22/18; B21C 37/06; B21C 37/30; B21C 31/00
See application file for complete search history.

(56) References Cited

U.S. PATENT DOCUMENTS

| | | | |
|---|---|---|---|
| 6,898,957 | B2 | 5/2005 | Slack |
| 7,073,366 | B2 | 7/2006 | Hruschak et al. |
| 7,146,835 | B2 | 12/2006 | Hruschak et al. |

OTHER PUBLICATIONS

International Search Report re PCT/CA2014/000434, issued by the ISA/CA on Jul. 29, 2014.
Written Opinion of the International Searching Authority re PCT/CA2014/000434, issued by the ISA/CA on Jul. 29, 2014.

*Primary Examiner* — Teresa M Ekiert
(74) *Attorney, Agent, or Firm* — Donald V. Tomkins

(57) ABSTRACT

An apparatus for keeping a slotted tubular liner in axial alignment with a seamer head through which it is passing adjusts the spatial position of the seamer head in response to inputs from liner centerline sensors. The seamer head is mounted on a seamer head carrier that is vertically movable relative to a seamer head frame, which in turn is horizontally movable relative to a base structure. A programmable logic controller is programmed to continually poll the liner centerline sensors to determine the position of the seamer head relative to the liner, and to instruct vertical and horizontal axis positioners to move the seamer head as necessary to make the seamer head's rotational axis substantially coincident with the centerline of the liner as the liner passes through the seamer head.

19 Claims, 11 Drawing Sheets

FIG. 1
(Prior Art)
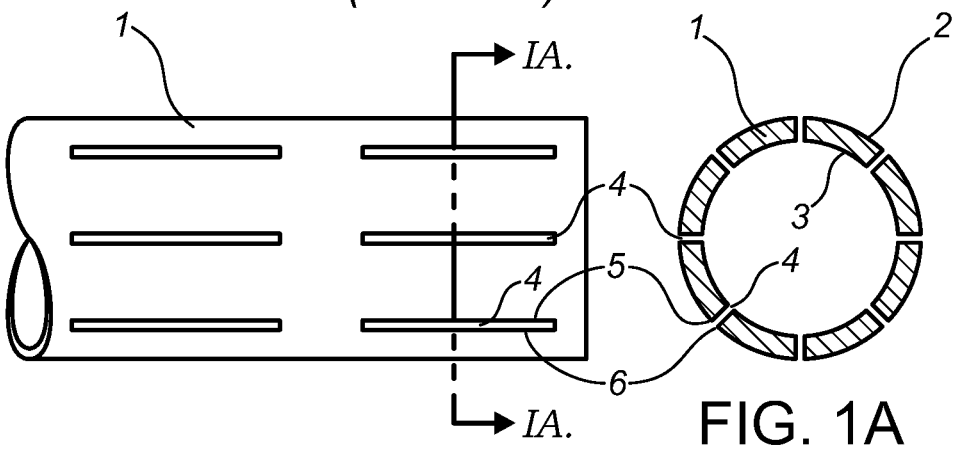
FIG. 1A
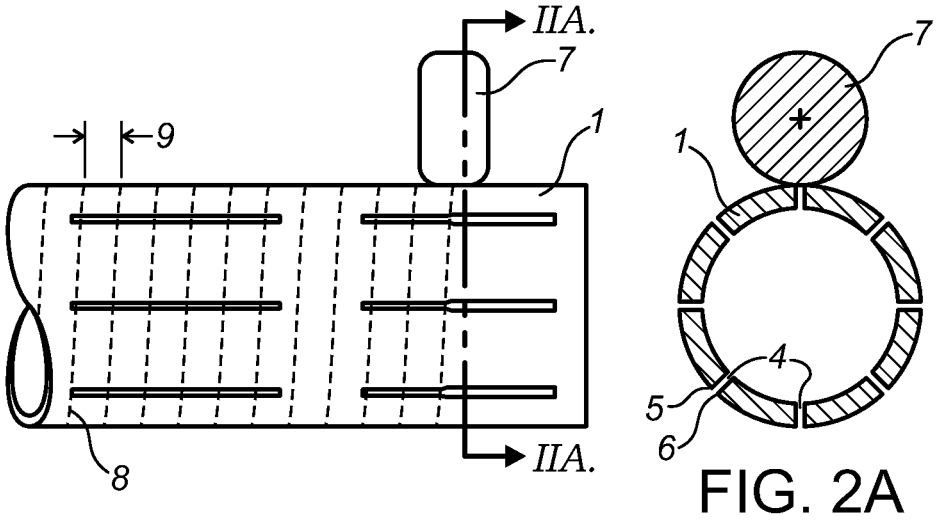
FIG. 2A
FIG. 2
(Prior Art)

FIG. 4
(Prior Art)
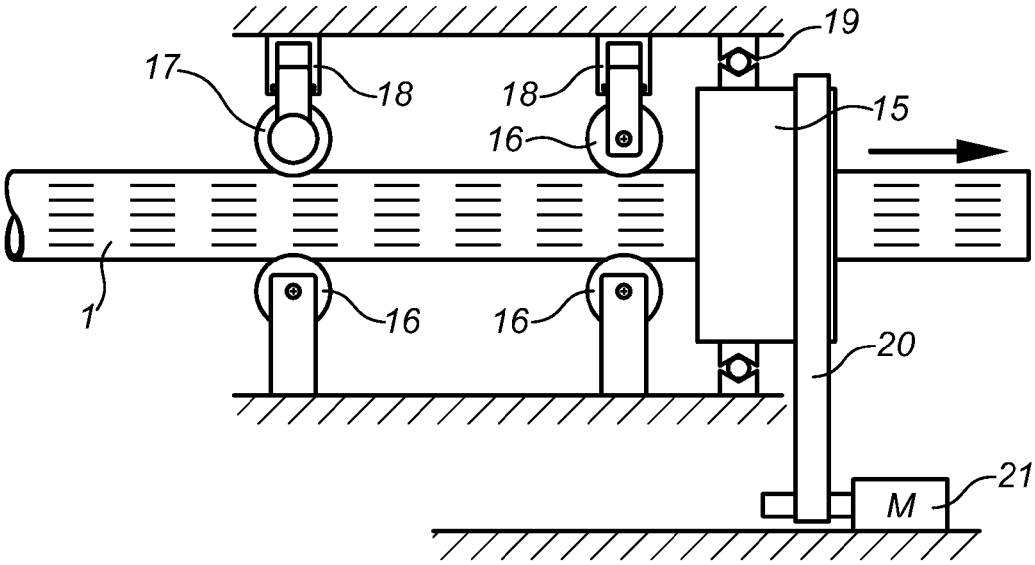
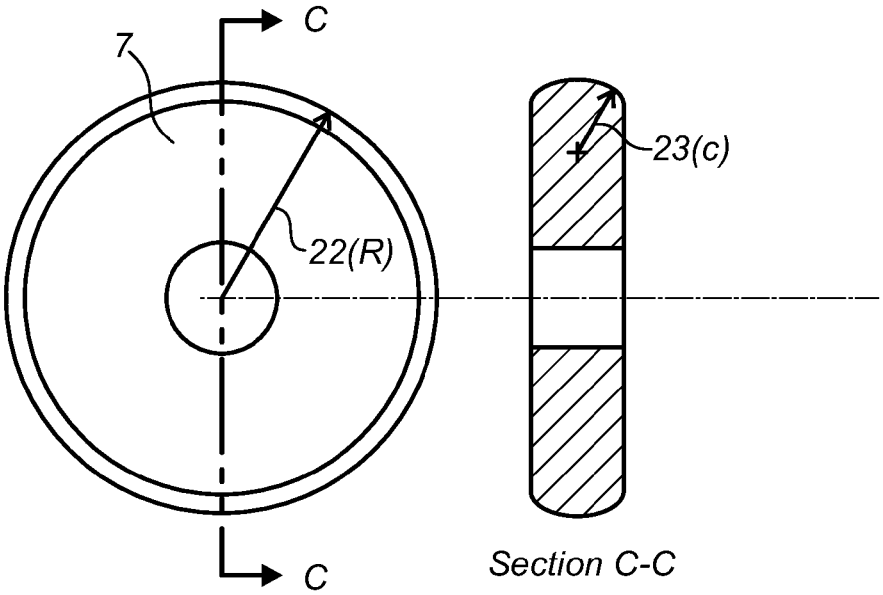
FIG. 5
(Prior Art)

AXIAL ALIGNMENT APPARATUS AND METHOD FOR MAINTAINING CONCENTRICITY BETWEEN A SLOTTED TUBULAR AND A SEAMER HEAD

FIELD OF THE DISCLOSURE

The present disclosure relates in general to "seaming" methods and apparatus for reducing slot width in slotted tubular members such as wellbore liners, and relates in particular to apparatus for keeping a slotted tubular concentric with a seamer head being used to seam the slots in the slotted tubular.

BACKGROUND

Technological advances in directional drilling within the oil industry have enabled wells to be completed with long horizontal sections extending into subsurface formations. Such long horizontal wellbores, often more than 1,000 meters long, permit fluids to be injected into or produced from a more extensive portion of a subsurface formation than would be possible using vertical wells, with commensurately greater recovery of petroleum fluids than from vertical wells. The horizontal sections of such wells are often completed with slotted steel tubulars (alternatively referred to as slotted liners) that function as screens or filters permitting flow of injected or produced fluids across the tubular wall while excluding the passage of solids.

For a slotted liner to function effectively as both a filter and a structural member in fine-grained reservoirs, and to be sufficiently rugged to endure installation handling loads, the slotted liner design is driven by three somewhat competing needs. To ensure adequate solid particle exclusion, the slot width must be on the order of the smaller sand grain sizes expected to be encountered in the formation. This is generally true even where fluids are injected out of the liner into the formation, because the effective radial stress in the sand tends to force sand grains into the well bore, even though fluids are flowing out. For reservoirs comprising very fine-grained material, slots narrower than 0.15 mm in width may be required. However, small slot widths tend to increase flow loss; therefore, a larger number of slots are needed per unit of contacted reservoir area to maintain flow capacity, while the liner must accommodate the larger number of slots without unacceptable loss of structural capacity.

The petroleum industry also recognises advantages, for production applications in particular, of slots that have a "keystone" shape in cross-section; i.e., with the flow channel through the wall of the tubular liner diverging (widening) from the external entry point to the internal exit point. This geometry reduces the tendency for sand grains to lodge or bridge in the slot, which could cause the slot to plug and restrict flow.

The required or desired width of the slots in a slotted tubular liner is commonly less than the slot width that can be formed using conventional rotary saw blades or other slot-forming technologies. Therefore, it is commonly necessary or desirable to narrow the width of the slots in slotted liners after initial formation of the slots. It is known to do this by applying pressure at or along the edges of the slots to plastically deform and displace material adjacent to the slot edges to narrow the slot width. The term "seaming", as used in this patent document, is to be understood as denoting or referring to the process or method of narrowing the width of slots in a slotted tubular liner by this means (i.e., application of pressure to induce plastic deformation resulting in reduction of the slot width). Similarly, the terms "seamer" and "seamer head", as used in this patent document, refer to apparatus used for purposes of seaming.

U.S. Pat. No. 6,898,957 (Slack), which is incorporated herein by reference in its entirety, teaches methods and apparatus for seaming slotted tubular liners. In accordance with certain embodiments taught by U.S. Pat. No. 6,898,957, these methods and apparatus provide at least one rigid contoured forming tool with means for applying a concentrated and largely radial load against the inside or outside cylindrical surface of a slotted metal tubular liner. The radial load thus applied at a given location on the contacted surface creates a localized zone of concentrated stress within the tubular material, which stress is sufficient to cause a significant zone of plastic deformation when the contact location is near the edge of a slot. Means are also provided for simultaneously displacing the forming tool or tools with respect to the tubular along path lines creating a typically helical sweep pattern over the cylindrical surface of the tubular. The sweep pattern is configured such that the extended zone of plastic deformation created as the forming tool passes each point on the path line covers an area sufficient to intersect the edges of all slots intended to be narrowed in width.

In accordance with methods taught in U.S. Pat. No. 6,898,957, the paths followed by the displacement of the forming tool or tools, as they follow the sweep pattern, traverse the edges of the slots a sufficient number of times and at sufficiently close intervals while maintaining sufficient contact force to plastically form the edges of all slots intersected along the slots' full lengths. The plastic deformation thus caused at the edges of the slots tends to narrow the width between opposing longitudinal edges of the slots in the contacted surface of the slotted metal tubular. Otherwise stated, the area affected by the extended zone of localized plastic flow, as the forming tool(s) move over the inside or outside surface of the slotted tubular liner, is sufficient to more than completely cover the edges of all slots to be narrowed by plastic deformation. The area swept by the forming tools need not be continuous over the entire surface of the slotted tubular liner, but optimally will include the area of influence from path lines occurring at at least two separate locations for each slot narrowed.

The steps in these methods firstly include providing a slotted tubular liner in which the slots:

- extend through the tubular wall;
- have longitudinal peripheral edges;
- are preferably of approximately equal length;
- typically have parallel slot walls (such as will result from cutting slots with a rotating saw blade); and
- are preferably arranged in rows of circumferentially-distributed slots, with adjacent rows of slots being separated by unslotted intervals or rings;

effectively forming a structure in which the material segments between slots act as short longitudinal beams spanning between unslotted intervals. Sub-lengths of the tubular liner having groups of one or more rows of slots are referred to as slotted intervals.

These methods also call for the steps of providing at least one and preferably multiple contoured rigid forming tools, preferably in the form of contoured rollers, and applying pressure to a local area on the exterior surface of the tubular by means of the rigid contoured forming tools, beginning at one end of a slotted interval. At the same time, the forming tools are moved over the surface of the tubular in a tight and preferably helical sweep pattern, progressing along the length of the tubular so as to cover each slotted interval in turn. The contoured forming tool shape, the radial load exerted by the forming tools against the tubular surface, the pitch of the helical path, and the number of passes of the forming tools (i.e., the number of times the above-described operation is repeated) are all adjusted so as to result in sufficient deformation of the edges of the slots along their length to uniformly narrow each slot to a desired width.

The methods and apparatus taught in U.S. Pat. No. 6,898,957 can also be used to narrow the width of slots in a slotted tubular as measured at the interior surface of the tubular. This is achieved by using steps substantially as described above for narrowing slots at the exterior surface, except that the rigid forming tools are configured to apply pressure to the interior surface of the slotted tubular. This causes the width of each slot to be narrowed along its interior edges creating an inverse keystone flow-channel shape, which shape is desirable for injection applications (i.e., where a fluid is being injected outward from the tubular into a surrounding subsurface formation).

As outlined in U.S. Pat. No. 6,898,957, the geometry of the generally keystone channel shape created by forming the edges of slots may be further characterized in terms of the rate at which the slot width increases with depth from the contacted surface edges, i.e., its divergence rate (or the angle of the slot wall). It will be generally appreciated that slots having a lower divergence rate can be expected to plug more easily than slots with a higher divergence rate for the same reason that the keystone shape is preferred over parallel wall slots. However, if the divergence rate is very high, the formed edges will have less material supporting them and therefore will be more susceptible to material loss through erosion or corrosion. In applications where this material loss causes a significant increase in slot width, the ability to screen to the desired particle size may be compromised.

For this reason, U.S. Pat. No. 6,898,957 also teaches methods for narrowing the width of slots in slotted metal tubulars by both forming the slot edges as described above and also to control the slot divergence rate or depth to which the slot is narrowed. These objectives can be achieved by manipulating the forming tool shape according to criteria set out in U.S. Pat. No. 6,898,957.

The methods and apparatus taught by U.S. Pat. No. 6,898,957 have proven to be very effective, and large quantities of slotted tubulars are seamed every year using such methods and apparatus. However, production efficiency using methods and apparatus in accordance with U.S. Pat. No. 6,898,957 can be hampered by the common problem of tubulars having a longitudinal bend or "bowing", typically resulting from factors such as differential cooling of longitudinal weldment areas during the manufacture of the tubulars. Such bends typically are not very dramatic, and not significant enough to cause problems with during installation or service when the tubulars are being used to make up drill strings or casing strings or as liners in horizontal wells. However, even slight longitudinal bowing can cause difficulties when present in a slotted tubular being seamed by a rotating seamer head of the type taught in U.S. Pat. No. 6,898,957.

The seamer head in U.S. Pat. No. 6,898,957 rotates about a rotational axis that is effectively fixed in space, given that the seamer head forms part of an apparatus that typically is stationary. In the ideal case, a length of slotted liner passing through the seamer head would be perfectly straight, such that its centroidal axis (i.e., centerline) would coincide with the rotational axis of the seamer head as it passes through the seamer head. In that idealized scenario, the pressures or forces exerted against the surface of the slotted tubular by all of the forming tools of the seamer head would be substantially uniform, thus promoting predictably uniform narrowing of the slots in the tubular.

However, if the centerline of the slotted liner deviates from concentricity with the rotational axis of the seamer due to an inherent longitudinal bend in the tubular, the pressures and forces exerted by the forming tools will vary, thus resulting in undesirable variations in slot width after seaming, or else entailing additional and intermittent steps to adjust the seaming equipment, or to adjust the means for supporting the non-rotating liner as it passes through the seamer (or, in some embodiments, as the seamer moves over the liner), such that the liner centerline is kept generally coincident with the rotational axis of the seamer head to facilitate acceptable quality control with respect to seamed slot width.

Although such adjustment steps may be helpful to address longitudinal bends in slotted liners that need to be run through a rotating seamer head, they decrease seaming efficiency and increase the cost of producing accurately-seamed slotted liners. Restricting seaming operations to slotted tubular liners having perfectly straight centroidal axes would be impractical and unrealistic. For these reasons, there is a need for improvements to seaming methods and apparatus that will allow longitudinally-bowed slotted liners to be seamed as effectively and efficiently as unbowed liners.

BRIEF SUMMARY

The present disclosure teaches axial alignment apparatus for aligning the vertical and horizontal position of the rotational axis of a seamer head with the centerline of a slotted tubular liner as the liner passes through the spindle bore of the seamer head. This is accomplished by providing liner centerline sensor means adapted to detect the position of the liner's centroidal axis (centerline). In illustrated embodiments, the liner centerline sensor means are provided in the form of liner position probes deployable to physically contact the exterior surface of the tubular in order determine the vertical and horizontal coordinates of the liner centerline. The illustrated embodiments of the axial alignment apparatus have two liner position probes for determining the vertical position of the liner and two liner position probes for determining the horizontal position of the liner. However, this is by way of example only; the number and angular orientation of the liner position probes could be different in alternative embodiments without departing from the scope of the present disclosure.

Although embodiments of axial alignment apparatus in accordance with the present disclosure are described and illustrated herein as having liner centerline sensor means in the form of liner position probes that physically contact the liner, this is by way of non-limiting example only. In alternative embodiments, the liner centerline sensor means could use optical means (such as lasers) or other means adapted or adaptable to sense the liner's spatial position without entailing physical contact with the liner.

In illustrated embodiments, the liner centerline sensors are mounted on or closely adjacent to the seamer head. In variant embodiments, however, the liner centerline sensor may be displaced in an axial direction away from the seamer head, with the axial alignment apparatus's control means (described later herein) being programmed or calibrated or otherwise adapted to translate readings from the displaced liner centerline sensors to provide sufficiently accurate determinations of the liner centerline's position at the spindle bore of the seamer head.

In accordance with methods taught herein, a slotted tubular liner is presented to the spindle bore of a seamer head by means of external apparatus that supports the liner such that the seamer head rotates relative to the liner, and the liner moves axially relative to the seamer head. The seamer head defines a rotational axis, which is the intended axis of relative rotation as between the seamer head and the liner when the centerline of the liner is coincident with the rotational axis. In some embodiments the seamer head may rotate about the rotational axis while the liner is non-rotating; in other embodiments the seamer head may be non-rotating while the tubing rotates. In some embodiments the relative axial movement as between the seamer head and the liner may be effected by axially moving the seamer head relative to an axially-stationary liner; in other embodiments the liner may be moved axially relative to an axially-stationary seamer head.

Other embodiments may provide for rotation of both the seamer head and the liner, but at different rotational speeds, such that there is still relative rotation as between the seamer head and the liner. Similarly, alternative embodiments may provide for axial movement of both the seamer head and the liner, either in opposite directions or in the same direction but at different speeds, such that there is still relative axial movement as between the seamer head and the liner.

Once the liner is supported on both sides of the seamer head by the external apparatus, the liner position probes can move into position against the cylindrical surface of the liner. Persons skilled in the art will appreciate that this can be done in a variety of ways in accordance with known technologies, and axial alignment apparatus within the scope of the present disclosure is not intended to be limited or restricted to the use of any particular means for positioning the liner position probes. By way of non-limiting example, however, in embodiments illustrated herein, the liner position probes are actuated by respective positioning motors and linear drive assemblies in conjunction with linear rails. Each positioning motor will place a corresponding spring-loaded follower wheel into contact with the liner, and will preload the follower wheel's spring-loaded guide assembly to a pre-determined position based upon the diameter of the liner (the cross-sectional perimeter of which is assumed to be circular, rather than having any out-of-roundness). The position of each spring-loaded follower wheel is then measured by a corresponding linear encoder. This process is carried out simultaneously and continuously with respect to all four probes as the liner moves through the seamer head spindle bore.

The apparatus incorporates a programmable logic controller (PLC) programmed to position the seamer head so as to be concentric with the liner at all times, by means of horizontal and vertical axis positioners. Once all four position probes have been positioned against the liner, the PLC will evaluate the position of each spring-loaded follower wheel by means of its associated linear encoder to determine the position of the rotational axis relative to the liner's centerline. If the rotational axis is coincident with the liner's centerline, no further action is taken. If the rotational axis is not coincident with the liner's centerline, the PLC will instruct either the vertical axis positioner or the horizontal axis positioner, or both, to move the seamer head either horizontally or vertically, or both, as necessary to make the rotational axis substantially coincident with the liner's centerline as the liner passes through the spindle bore of the seamer head. The PLC continuously polls all linear encoders at sufficiently frequent intervals to ensure that the rotational axis remains at least substantially coincident with the liner's centerline at all times as the liner moves through the seamer head.

Accordingly, in one aspect the present disclosure teaches an apparatus for aligning the rotational axis of a seamer head with the centerline of a tubular member disposed within a spindle bore of the seamer head parallel to the rotational axis, wherein the apparatus comprises:

- positioning means, for adjusting the spatial position of the seamer head in a direction transverse to the rotational axis;
- centerline sensor means, for sensing the spatial position of the tubular member's centerline where the tubular member passes through the spindle bore; and
- control means adapted to receive centerline position data from the centerline sensor means, to determine the spatial position of the tubular member's centerline based on received centerline position data, to compare the spatial position of the tubular member's centerline relative to the seamer head's rotational axis, and to actuate the positioning means as necessary to move the seamer head in a direction transverse to the seamer head's rotational axis so as to bring the rotational axis into substantial concentricity with the tubular member's centerline at the location of the seamer head.

In a second aspect the present disclosure teaches an axial alignment apparatus comprising:

- a base structure;
- a seamer head frame mounted to and horizontally movable relative to the base structure;
- a seamer head carrier mounted to and vertically movable relative to the seamer head frame;
- a seamer head mounted to the seamer head carrier, with the seamer head defining a rotational axis and further having a spindle bore for receiving a tubular liner oriented with its centerline parallel to the rotational axis;
- horizontal positioning means, for adjusting the horizontal position of the seamer head frame relative to the base structure;
- vertical positioning means, for adjusting the vertical position of the seamer head carrier relative to the seamer head frame;
- a plurality of liner centerline measurement probes mounted in association with the seamer head carrier and adapted for contacting engagement with the cylindrical exterior surface of a tubular liner disposed within the spindle bore of the seamer head;
- rotation means, for providing relative rotation about the rotational axis as between the tubular liner and the seamer head;
- axial movement means, for providing relative axial movement as between the tubular liner and the seamer head;
- a plurality of linear encoders, each linear encoder being associated with one of the centerline measurement probes and being adapted to measure the spatial position of its associated centerline measurement probe when the probe is in contact with the exterior surface of the liner; and
- control means programmed to poll the linear encoders to determine the spatial positions of their associated centerline measurement probes, to calculate the spatial position of the liner centerline based on data polled from the encoders, to compare the spatial position of the liner centerline relative to the rotational axis, and to actuate one or more of the horizontal and vertical positioning means to move the seamer head as necessary to bring the rotational axis into substantial concentricity with the liner centerline.

In a first embodiment, the rotation means is adapted to rotate the seamer head about the rotational axis, and the axial movement means is adapted to move a tubular liner axially through the spindle bore of the seamer head.

In a second embodiment, the rotation means is adapted to rotate the seamer head about the rotational axis, and the axial movement means is adapted to move the seamer head axially relative to a tubular liner disposed within the spindle bore of the seamer head.

In a third embodiment, the axial movement means is adapted to move a tubular liner axially through the spindle bore of the seamer head, and the rotation means is adapted to rotate the tubular liner.

In a fourth embodiment, the axial movement means is adapted to move the seamer head axially relative to a tubular liner disposed within the spindle bore of the seamer head, and the rotation means is adapted to rotate the tubular liner.

The control means may comprise a programmable logic controller (PLC) or any other functionally suitable programmable control device.

In a third aspect, the present disclosure teaches a method for maintaining axial alignment between a tubular liner and a seamer head through which the tubular liner is passing. This method includes the steps of:

- providing a seamer head defining a spindle bore and a rotational axis;
- disposing a tubular liner within the spindle bore, with the centerline of the liner parallel to the rotational axis;
- determining the spatial position of the liner centerline relative to the spatial position of the rotational axis; and
- re-positioning the seamer head as necessary to bring the rotational axis into substantial concentricity with the liner centerline.

BRIEF DESCRIPTION OF THE DRAWINGS

Embodiments of apparatus and methods in accordance with the present disclosure will now be described with reference to the accompanying figures, in which numerical references denote like parts, and in which:

FIG. 1 illustrates a slotted tubular liner having circumferentially-arrayed rows of longitudinal slots.

FIG. 1A is a cross-section through the slotted liner in FIG. 1.

FIG. 2 illustrates slots in a slotted liner as in FIG. 1 being seamed by a prior art forming roller as taught in U.S. Pat. No. 6,898,957.

FIG. 2A is a cross-section through the slotted liner and forming roller in FIG. 2.

FIG. 4 illustrates one embodiment of a prior art seaming apparatus as taught in U.S. Pat. No. 6,898,957 having a stationary rotating seamer head, with a non-rotating slotted liner passing longitudinally through the seamer head.

FIG. 5 illustrates geometrical parameters of an exemplary prior art forming roller as taught in U.S. Pat. No. 6,898,957.

DESCRIPTION

Prior Art Seaming Apparatus

Figure 3:
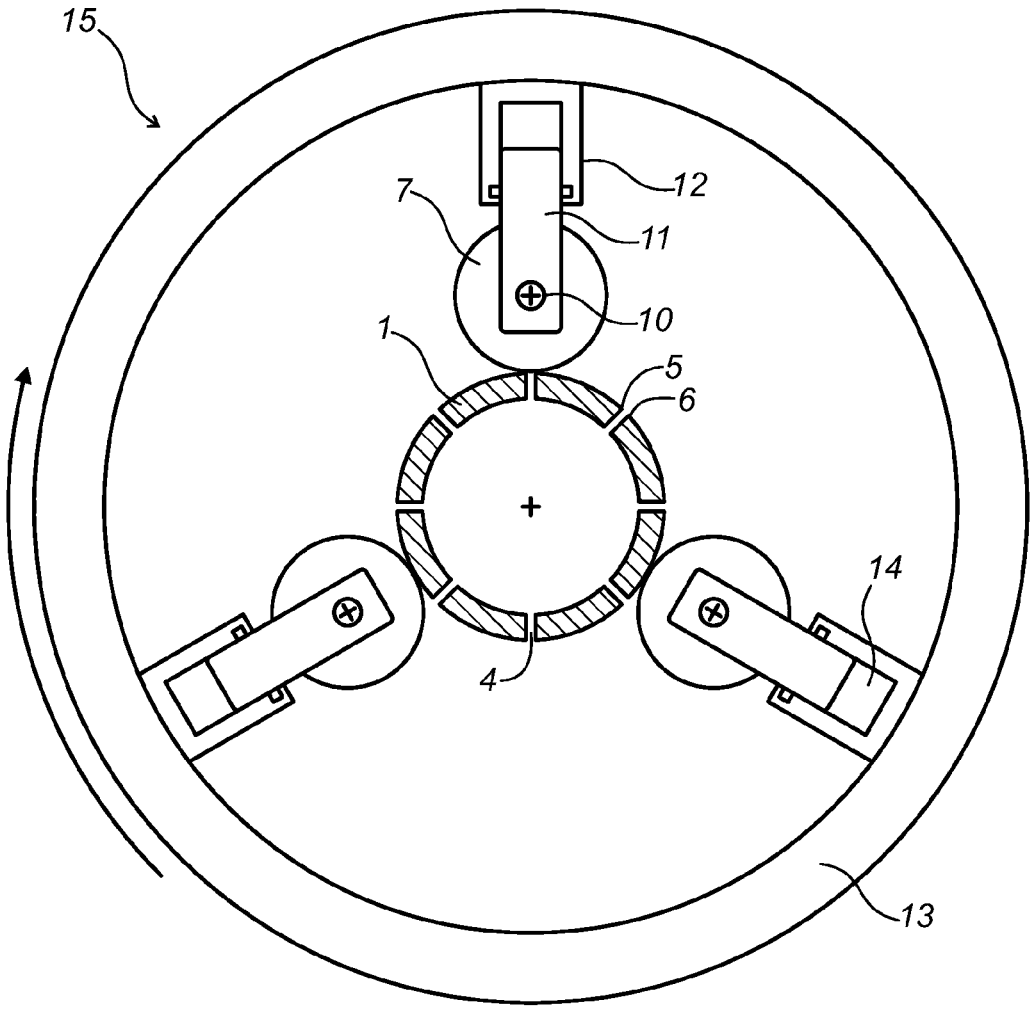
FIG. 3 (Prior Art)
FIG. 3 is an elevational view of a prior art seamer head as taught in U.S. Pat. No. 6,898,957, carrying three forming rollers shown in contact with a slotted liner passing through the seamer head.

To promote optimal and comprehensive understanding of axial alignment apparatus in accordance with the present teachings, the physical structure and operation of a prior art seaming apparatus as disclosed in U.S. Pat. No. 6,898,957 will be described below, having reference to FIGS. 1-7. It is to be understood, however, that notwithstanding the description and illustration provided herein with respect to U.S. Pat. No. 6,898,957, axial alignment apparatus and methods in accordance with the present disclosure are not in any way limited or restricted to use in association with seaming apparatus and methods as taught in U.S. Pat. No. 6,898,957.

In accordance with U.S. Pat. No. 6,898,957, and as illustrated in FIGS. 1 and 1A, a slotted tubular liner 1 has an exterior surface 2, an interior surface 3, and one or more longitudinal slots 4, each having exterior longitudinal peripheral edges 5 and 6 as illustrated in FIG. 1. To reduce the width between exterior peripheral edges 5 and 6 of slots 4, a contoured rigid forming tool, typically configured in the form of a forming roller (alternatively referred to as a seaming roller) 7, is forced into contact with the exterior surface 2 of slotted liner 1 to apply localized pressure while being moved largely transversely with respect to liner 1 along a helical path 8 as shown in FIGS. 2 and 2A. Sufficient contact pressure is applied to liner 1 through forming roller 7 to plastically deform peripheral edges 5 and 6 of slots 4 as roller 7 traverses slots 4 following a helical path 8. The pitch 9 and total length of helical path 8 are adjusted to ensure that the localized zones of plastic deformation created as roller 7 sequentially traverses a given slot 4 occur at close enough intervals to effectively continuously deform the slot along its entire length.

FIG. 2 illustrates the forming process at an intermediate step where the slot width at peripheral edges 5 and 6 of slots 4 already traversed by forming roller 7 following helical path 8 has been narrowed.

Having regard to the teachings of U.S. Pat. No. 6,898,957, it will be apparent to persons skilled in the art that for a given slotted tubular liner, there will be relationships between the reduction in slot width and:

the radial force applied to the forming roller;

the shape of the forming roller;

the pitch of the helical forming path;

the number of times the roller traverse is repeated; and to a limited extent, the speed at which the roller is moved relative to the liner surface.

The manner in which these variables interact may be generally understood as follows:

The greater the available force, the greater the amount of plastic deformation possible.

For a given available force, the shape of the forming roller generally controls the magnitude and longitudinal extent over which the reduction in slot width occurs for a single traverse of the roller over a slot.

The pitch of the helical forming path should be coordinated with the axial extent over which the reduction in slot width occurs for a single traverse of the roller over a slot, to ensure that the width reduction occurs over the entire longitudinal extent of the slot.

Repeated traverses of the roller over the same slot location at the same load tend to increase the amount of deformation by incrementally smaller amounts as the number of traverses is increased.

The maximum radial force which may be applied to the forming roller is a function of the manner in which the slotted liner is supported and, therefore, how the force applied through the roller is reacted. It will be evident that there exist numerous means of supporting the liner and reacting the radial force applied through a forming roller 7, including providing support on the inside of the liner. However, it is most convenient if fixturing acting primarily on the exterior surface 2 can support the liner and is arranged to react the radial force applied through a forming roller to the liner through one or more opposing radial rollers acting at or near the same axial plane. The rollers most conveniently apply these opposing radial forces when mounted in a common rigid frame, similar to the manner of a "steady rest" commonly used to support a long work piece in a lathe. It will be evident that two or more rollers can be arranged to act as forming rollers, in which case interleaved "multiple start" helical paths can be generated as a function of the liner rotation with respect to the rollers with associated benefits in production rate.

One such configuration is shown in FIG. 3. As illustrated in FIG. 3, the axles 10 of three radially-opposed forming rollers 7 are attached to the pistons 11 of three hydraulic actuators 12, each positioned at approximately 120 degrees around liner 1 and fastened to the forming head frame 13. Load is applied to the forming rollers 7 by application of fluid pressure (conceptually denoted in FIG. 3 by reference number 14). Together this assembly is referred to as a forming head (alternatively referred to as a seamer head) 15. This configuration substantially reduces the tendency of the liner to bend and provides a radial load capacity enabling a reasonably large formed zone without permanent distortion of the liner's cross-sectional shape for typical slotted liner materials.

The means by which one or more forming rollers 7 carried in seamer head 15 is caused to move in a helical path 8, with respect to liner 1, may be accomplished in various ways. As a first example, liner 1 may be rotated while the forming head is moved axially in synchronism with the rotational position, in the manner of a lathe used for threading or turning operations. As a second example, the forming head may be rotated while liner 1 is moved axially through the head without rotation, in synchronism with the forming roller rotation. Other alternative architectures are described in U.S. Pat. No. 6,898,957.

In one embodiment, seaming apparatus in accordance with U.S. Pat. No. 6,898,957 employs the above-noted second example of these architectures in a machine illustrated in FIG. 4. As shown in FIG. 4, the slotted liner 1 is positioned with respect to forming head 15 by guide rollers 16 and one or more drive rollers 17. Force applied by hydraulic actuators 18 ensures that liner 1 is held in place, while drive roller 17 develops sufficient friction to axially displace liner 1 relative to the forming head 15 (as denoted by the directional arrow in FIG. 4) while forming head 15 is rotating. Forming head 15 is mounted in bearings 19 allowing it to be rotated by means of a drive belt 20 (or a drive chain, gear arrangement, or other suitable means) driven by a motor 21. The combination of axial and rotational motions thus provided causes forming rollers 7 to follow a helical path 8 along the outside surface of liner 1 as shown in FIG. 2, with the pitch 9 of helical path 8 being controlled by adjusting the axial feed rate with respect to the rotational speed of forming head 15.

The shape of the forming tool may be used in combination with the other process control variables such as load, pitch, and number of roller traverses to adjust the amount by which a slot is narrowed and the depth over which the slot narrowing occurs. The means by which roller shape controls these outcomes may be generally characterized in terms of the roller radius 22(R) and profile radius 23(*c*) as illustrated in FIG. 5. While the profile shape may take various forms, a simple convex shape, as shown in FIG. 5, has been found to provide satisfactory control of slot width reduction when forming longitudinal slots following a largely transverse helical path.

Figure 6:
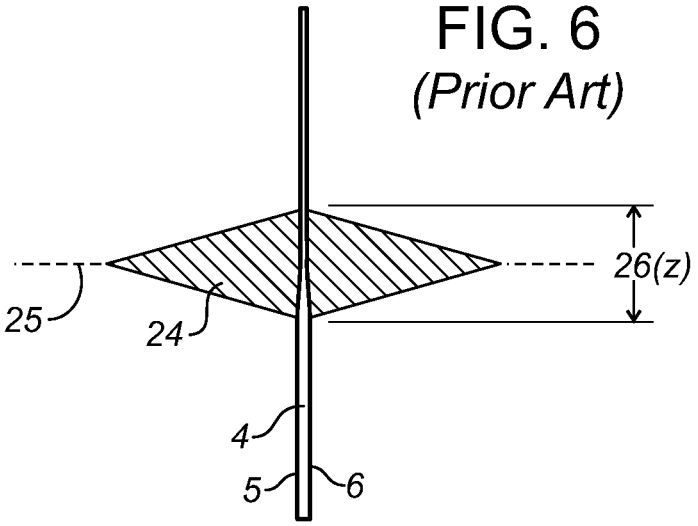
FIG. 6 (Prior Art)
FIG. 6 is a plan view of a longitudinal slot that has been transversely seamed by a forming roller as taught in U.S. Pat. No. 6,898,957, illustrating the areal extent of zones adjacent to the slot subject to plastic deformation due to forces exerted by the forming roller.
Figure 7:
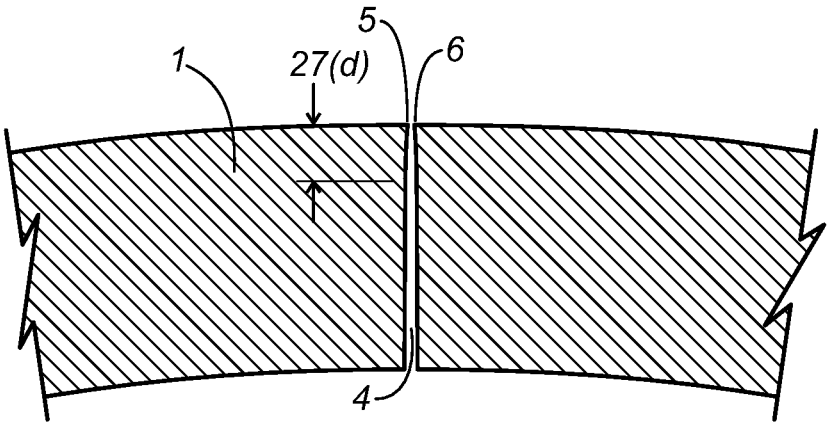
FIG. 7 (Prior Art)
FIG. 7 is a cross-sectional detail through a slot through the wall of a slotted liner as in FIG. 6, illustrating the shape of the slot after transverse seaming.

To understand how these geometric parameters may be advantageously manipulated, consider the shape of the zone of plasticity caused as a roller 7, having a generally smooth convex profile shape, crosses the center of a slot 4 following a largely transverse path. As shown in FIG. 6, the width of the areal extent of plastic deformation 24 as a function of position along the roller path 25, caused when the roller traverses the slot, tends to be greatest nearest the slot. This occurs because the stressed material is least confined at the slot and creates an effective formed length 26(*z*) for a single traverse of forming roller 7 over a slot. Correspondingly, the depth of plastic deformation is greatest at the slot, producing narrowing of the through-wall channel shape to a forming depth 27(*d*) as shown in FIG. 7. It will be apparent that if the pitch exceeds formed length 26(*z*), the areal extent of successive roller traverses will not overlap sufficiently along the slot edges to effectively continuously narrow the slots over their entire length, and the slot is said to be under-formed.

Within the context of the preferred embodiment, there is a maximum allowable roller load (F) dependent on the structural capacity of liner 1 when loaded by the forming rollers within the forming head. Furthermore, the amount by which the slot width is to be narrowed ($\Delta W$) may be treated as a given for purposes of understanding the choice of forming roller radius 22(R) and profile radius 23(*c*). To maximize production rate, it is preferable to produce the required reduction in slot width by only rolling the surface of liner 1 once, with the roller load at or near the maximum allowable value (F). Under these assumptions, then, for a given roller radius 22(R), there is a minimum profile radius 23(*c*), referred to as the critical radius, for which the desired $\Delta W$ is obtained for a single traverse of the slot, as illustrated in FIG. 6, with a corresponding value of formed length 26(*z*). For these "optimum" conditions, the pitch must largely correspond to formed length 26(*z*) to avoid either under-forming or over-forming the slot. Pitch (P) may therefore be treated as a dependent variable. Such a minimum profile radius is also optimized to form the edges most completely to the ends of the slots.

Next consider the effect of variations in roller radius 22(R) assuming that profile radius 23(*c*) is "optimally" selected as described above. It will be apparent that as 22(R) is decreased, the extent of the zone of stress under the roller is reduced in the direction of rolling (typically normal or perpendicular to the slot direction); therefore, radius 23(*c*) must be increased to maintain the condition of constant ΔW and formed length 26 (*z*) will correspondingly increase. Because pitch increases with formed length 26(*z*), the rate of production increases for decreasing roller radius 22 (R). It should also be apparent that the forming depth 27(*d*) will decrease as roller radius 22(R) is decreased due to the reduced extent of the zone of stress under the roller, normal to the slot direction. This provides a means to control the shape of the formed edges concurrent with the rate of divergence in the flow channel.

However, it is preferable if the profile radius 23(*c*) is somewhat greater than the critical value, as this allows greater flexibility in accommodating randomness in the numerous variables (such as material properties) that affect slot width. The greater flexibility derives from the fact that as radius 23(*c*) becomes greater than the critical value, the pitch must on average be reduced to keep ΔW constant. Therefore, if variations in parameters (such as a decrease in strength) necessitate less forming, the pitch may be increased to compensate without causing under-forming. This ability to use variation in pitch to provide fine control of the final slot width is of practical benefit for automating the seaming process. In particular, if the slot width is measured directly after the slots are formed, variations from the desired width may be compensated for subsequent formed intervals by adjusting either the load or pitch but preferably the pitch. This feedback task may be performed manually or automated using a suitable means to measure slot width.

Therefore, in preferred embodiments, the roller and profile radii are selected to ensure that adequate sensitivity of slot width to pitch is maintained to facilitate process control without compromising the ability of the roller to form the edges of slots near their ends.

Axial Alignment Apparatus

FIGS. 8, 9, and 12A-12D illustrate an axial alignment apparatus 100 for keeping a slotted tubular liner 101 concentric with a rotating seamer head 115 as seamer head 115 narrows the width of the slots in slotted liner 101, by adjusting the vertical and horizontal positions of seamer head 115 as liner 101 passes through the spindle bore 117 of seamer head 115. This is accomplished by means of liner centerline sensor means provided, in the illustrated embodiment, in the form of a plurality of liner position probes 120H (for horizontal position sensing) and 120V (for vertical position sensing) that engage the exterior surface of the liner to determine the vertical and horizontal position of the liner's centroidal axis (or centerline) CL.

Figure 9:
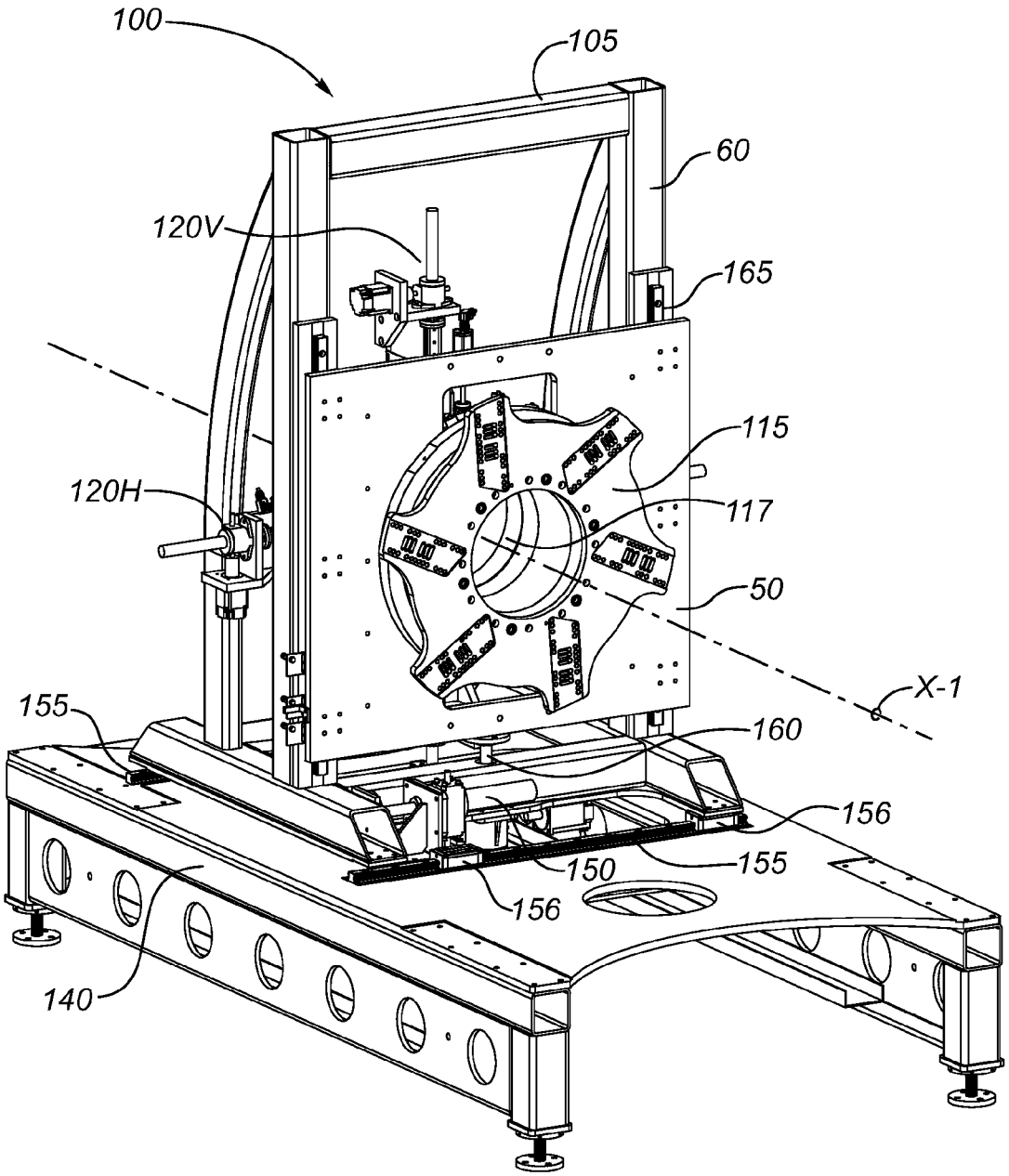
FIG. 9 is a second isometric view of the seamer head and axial alignment apparatus shown in FIG. 8.

In the illustrated embodiment, seamer head 115 is mounted to a seamer head carrier structure 50 so as to be rotatable relative to seamer head carrier 50 about a horizontal rotational axis X-1. Seamer head carrier 50 is mounted to a seamer head frame 60 such that the vertical position of seamer head carrier 50 relative to seamer head frame 60 is adjustable. This functionality may be provided (by way of non-limiting example) by providing vertical slide rails or tracks 165 on seamer head frame 60 as shown in FIG. 9, with seamer head carrier 50 being adapted to slidingly or rollingly engage vertical slide rails or tracks 165 (by suitable slide rail/track engagement means).

Figure 8:
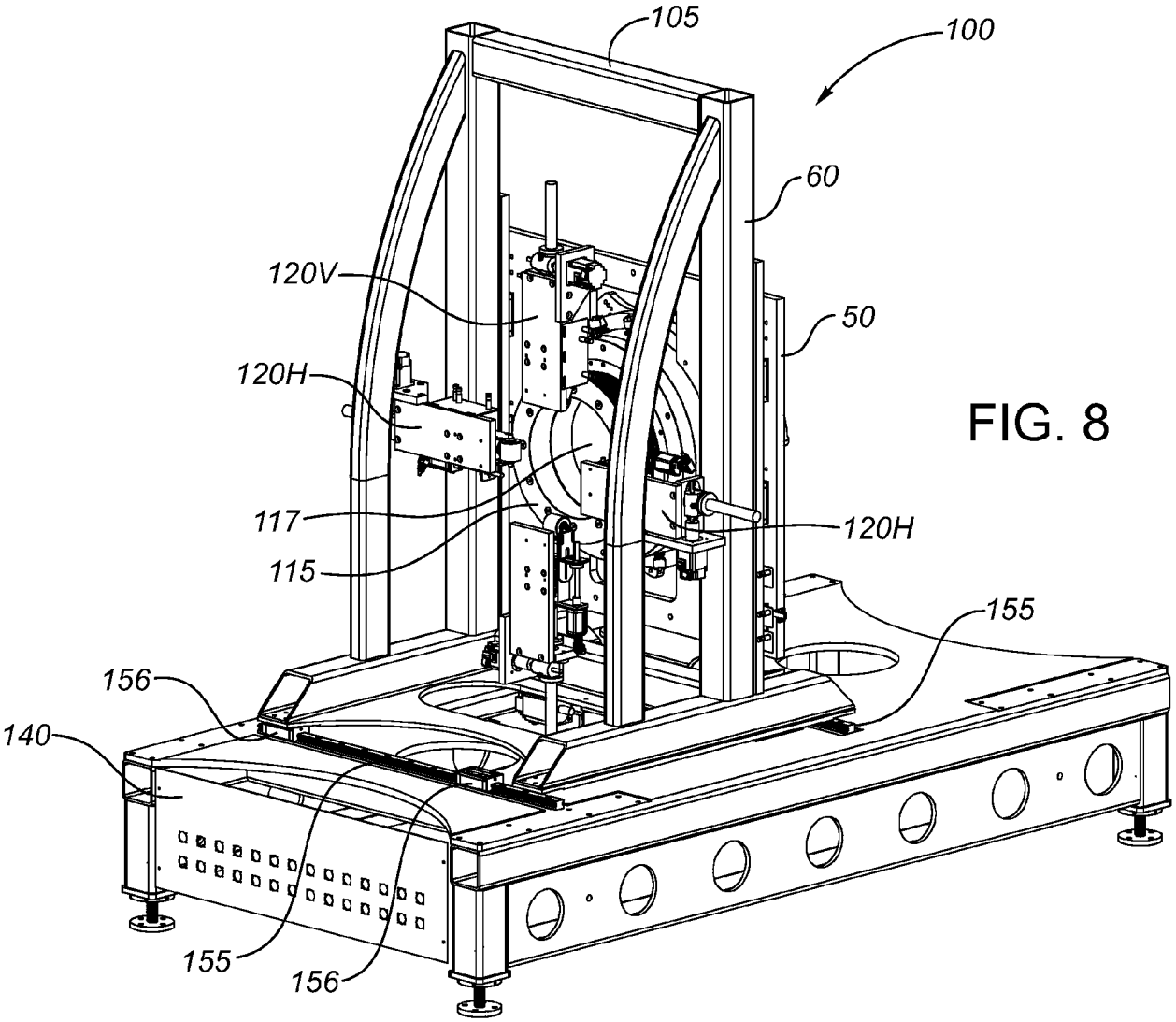
FIG. 8 is a first isometric view of a seamer head mounted in association with one embodiment of an axial alignment apparatus in accordance with the present disclosure.

Seamer head frame 60 is mounted to a base structure 140 such that the horizontal position of seamer head frame 60 relative to base structure 140 (in a direction transverse to rotational axis X-1) is adjustable. This functionality may be provided (by way of non-limiting example) by providing horizontal slide rails 155 on base structure 140 as shown in FIGS. 8 and 9, with seamer head frame 60 being adapted to slidingly or rollingly engage horizontal slide rails or tracks 155 (by suitable slide rail/track engagement means indicated by reference number 156).

In the illustrated embodiment, alignment apparatus 100 incorporates two diametrically-opposed vertical liner position probes 120V and two diametrically-opposed horizontal liner position probes 120H. However, this is by way of example only; the number and angular orientation of the liner position probes could be different in alternative embodiments.

In accordance with methods disclosed herein, a slotted liner 101 is presented to the seamer head spindle bore 117 by means of an external apparatus (not shown) that holds liner 101 in a vertically and horizontally stationary position while allowing axial movement of liner 101 relative to seamer head 115. Once liner 101 is supported on both sides of seamer head 115 by the external apparatus, the liner position probes 120H, 120V can move into position.

Figure 11:
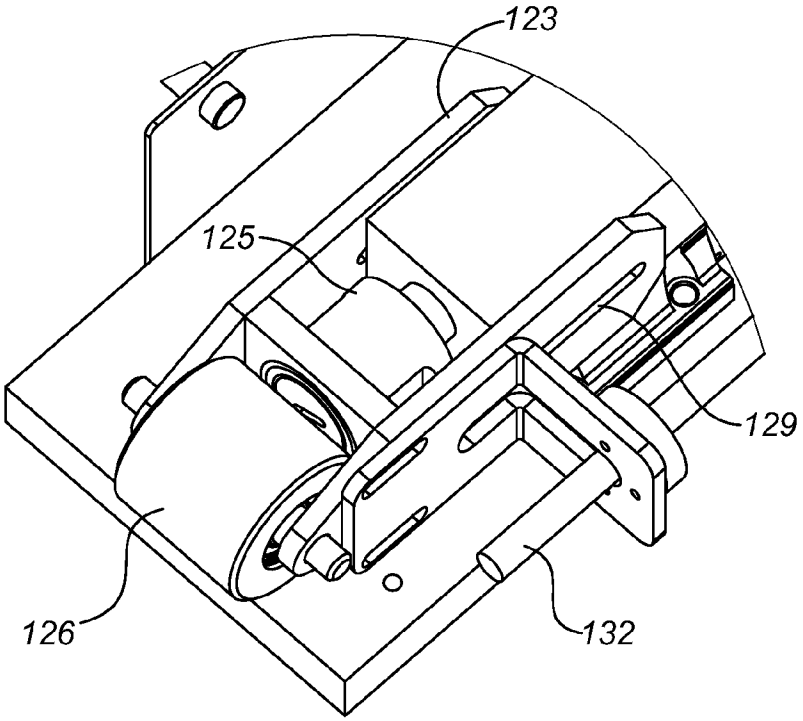
FIG. 11 is an isometric detail of the spring-mounted follower of the liner position probe shown in FIG. 10.
Figure 10:
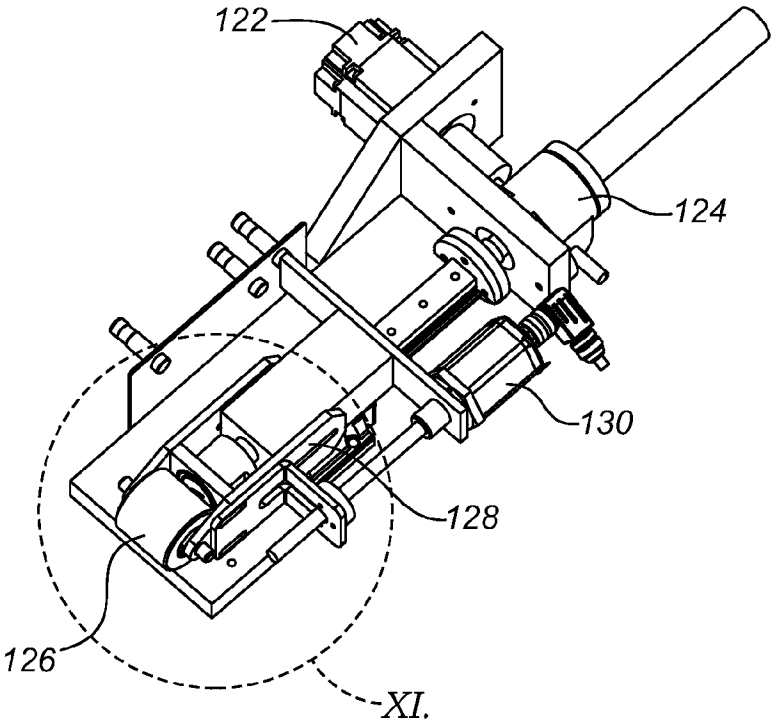
FIG. 10 is an isometric view of one embodiment of a liner position probe suitable for use in the axial alignment apparatus shown in FIGS. 8 and 9.

Referring now to FIGS. 10 and 11, the liner position probes 120H, 120V are actuated by respective positioning motors 122 and linear drive assemblies 124 in conjunction with linear rails. Each positioning motor 122 will place a corresponding spring-loaded follower wheel 126 into contact with slotted liner 101, and will preload the follower wheel's spring-loaded guide assembly 128 to a pre-determined position based upon the diameter of liner 101 (the cross-sectional perimeter of which is assumed to be circular, rather than incorporating ovality). The position of each spring-loaded follower wheel 126 is then measured by a corresponding linear encoder 130. This process is carried out simultaneously and continuously with respect to all liner position probes as liner 101 moves through seamer head spindle bore 117.

Referring back to FIG. 9, apparatus 100 incorporates a programmable logic controller, or PLC (not shown), programmed to position seamer head 115 so as to be concentric with slotted liner 101 at all times, by means of one or more horizontal axis positioners 150 and one or more vertical axis positioners 160. Once all four liner position probes 120H, 120V have been positioned, the PLC will evaluate the position of each spring-loaded follower wheel 126 by means of its associated linear encoder 130 to determine the position of seamer head 115 relative to centerline CL of liner 101. If the rotational axis X-1 of seamer head 115 is coincident with centerline CL of liner 101, no further action is taken. However, if rotational axis X-1 is not coincident with centerline CL, the PLC will instruct either vertical axis positioner 160 or horizontal axis positioner 150, or both, to move seamer head 115 either vertically or horizontally, or both, as necessary to make rotational axis X-1 substantially coincident with liner centerline CL as liner 101 passes through spindle bore 117 of seamer head 115. The PLC continuously polls all linear encoders 130 at sufficiently frequent intervals to ensure that rotational axis X-1 of seamer head 115 remains substantially coincident with liner centerline CL as liner 101 passes through spindle bore 117.

Persons skilled in the art will appreciate that the function of horizontal axis positioner 150 and vertical axis positioner 160 may be provided by a variety of means in accordance with known technology. By way of non-limiting example, the axis positioners may comprise hydraulic cylinders, pneumatic cylinders, or geared mechanisms (such as rack-and-pinion arrangements). However, embodiments of axial alignment apparatus coming within the intended scope of the present disclosure are not limited to the use of any particular axis positioning means, including any of the above-noted examples of axis positioning means.

The operation of axial alignment apparatus 100 may be best understood with reference to FIGS. 12A, 12B, 12C, and 12D, which sequentially illustrate how apparatus 100 functions when the centerline of a slotted liner 101 positioned in spindle bore 117 is offset from the rotational axis of seamer head 115.

Figure 12A:
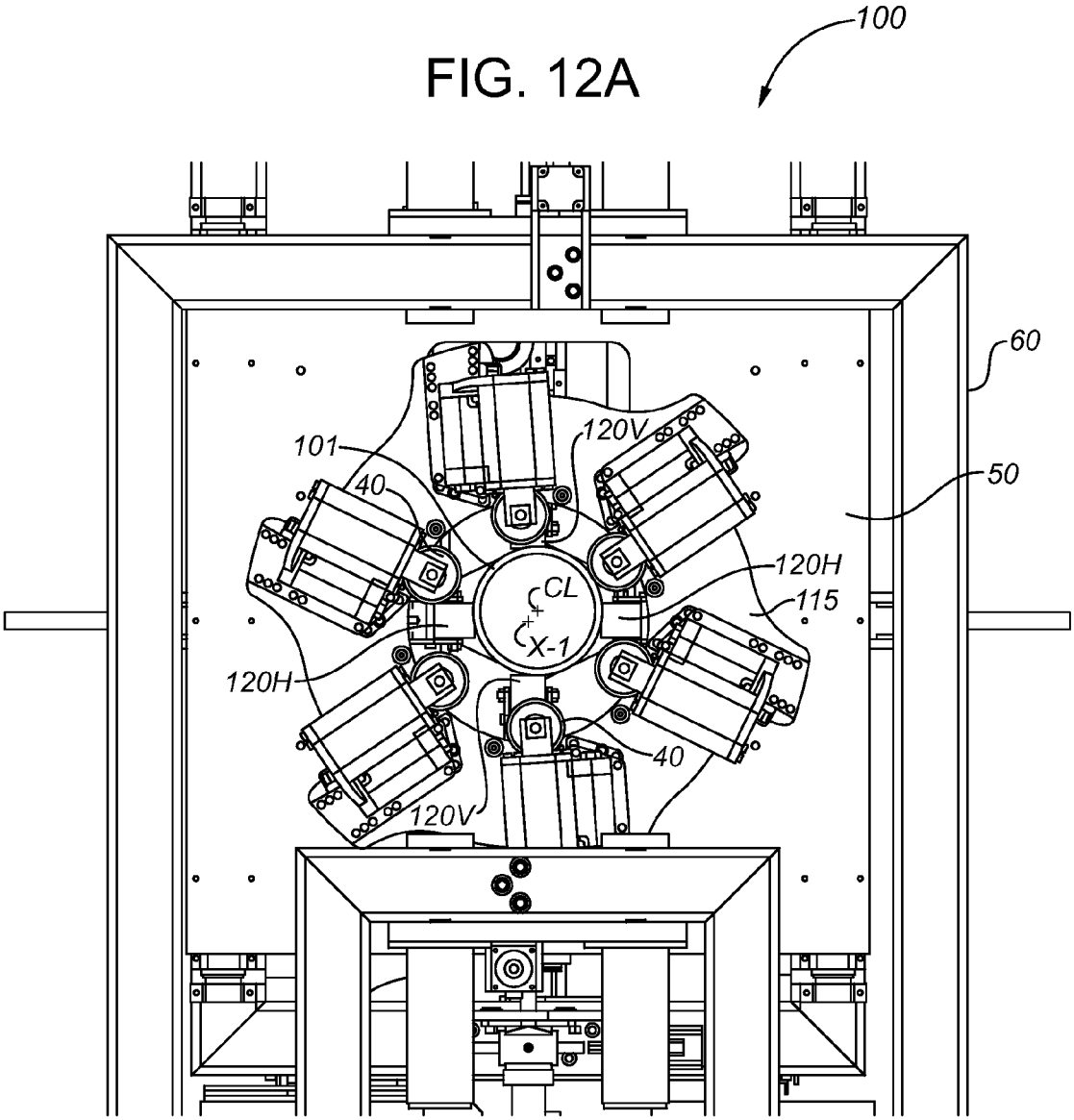
FIG. 12A is an elevation showing a slotted tubular liner positioned in association with the axial alignment apparatus shown in FIGS. 8 and 9, with the centerline of the slotted liner being both laterally and vertically offset from the rotational axis of the seamer head.

In FIG. 12A, liner centerline CL is shown offset both vertically and horizontally from rotational axis X-1 of seamer head 115.

Figure 12B:
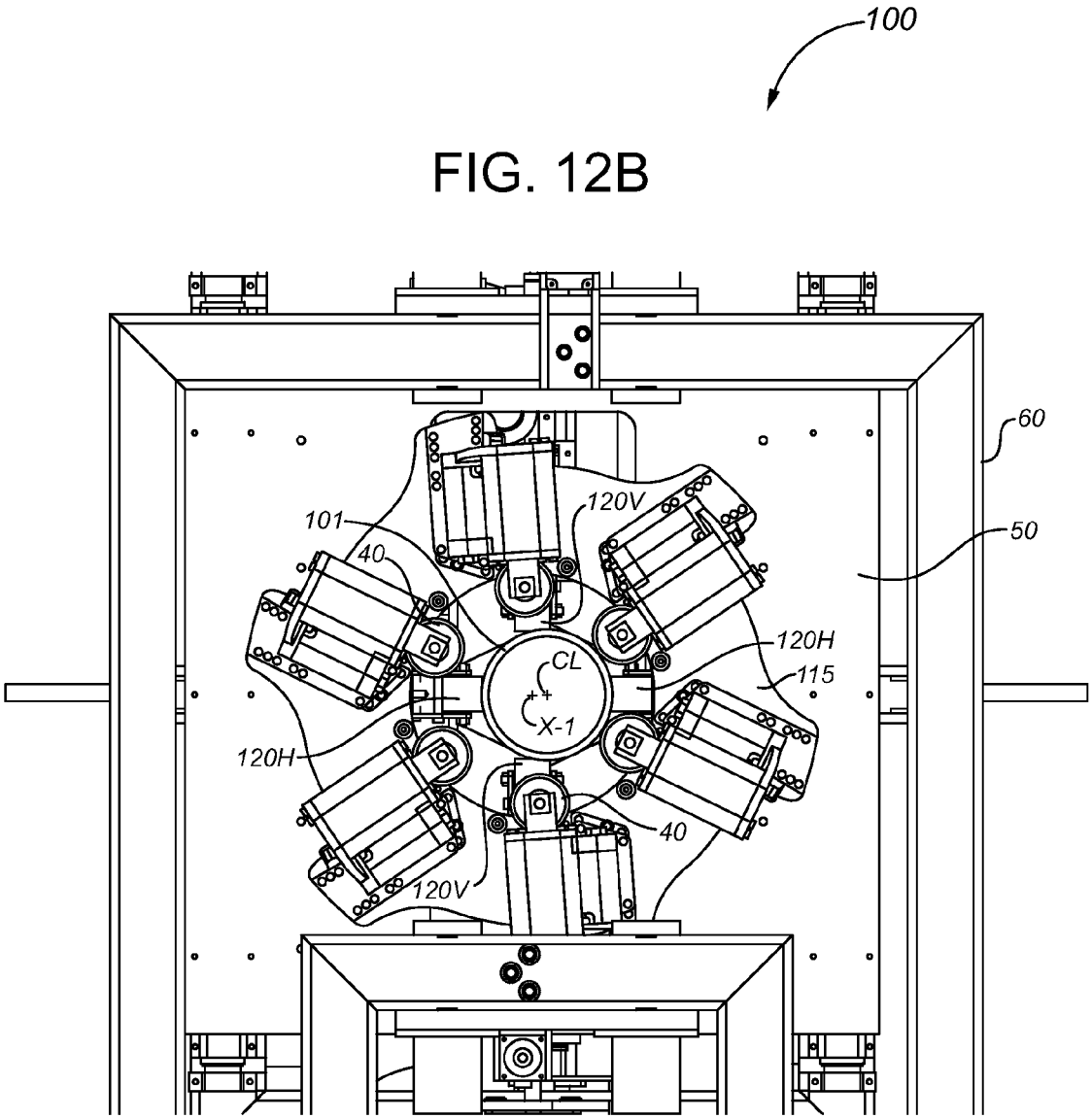
FIG. 12B is an elevation similar to FIG. 12A, but after the vertical axis positioners have repositioned the seamer head such that the vertical position of the seamer head's rotational axis corresponds to the vertical position of the centerline of the slotted liner.

In FIG. 12B, the one or more vertical axis positioners 160 have repositioned seamer head carrier 50 (and seamer head 115 in turn), such that the vertical position of rotational axis X-1 corresponds to the vertical position of liner centerline CL.

Figure 12C:
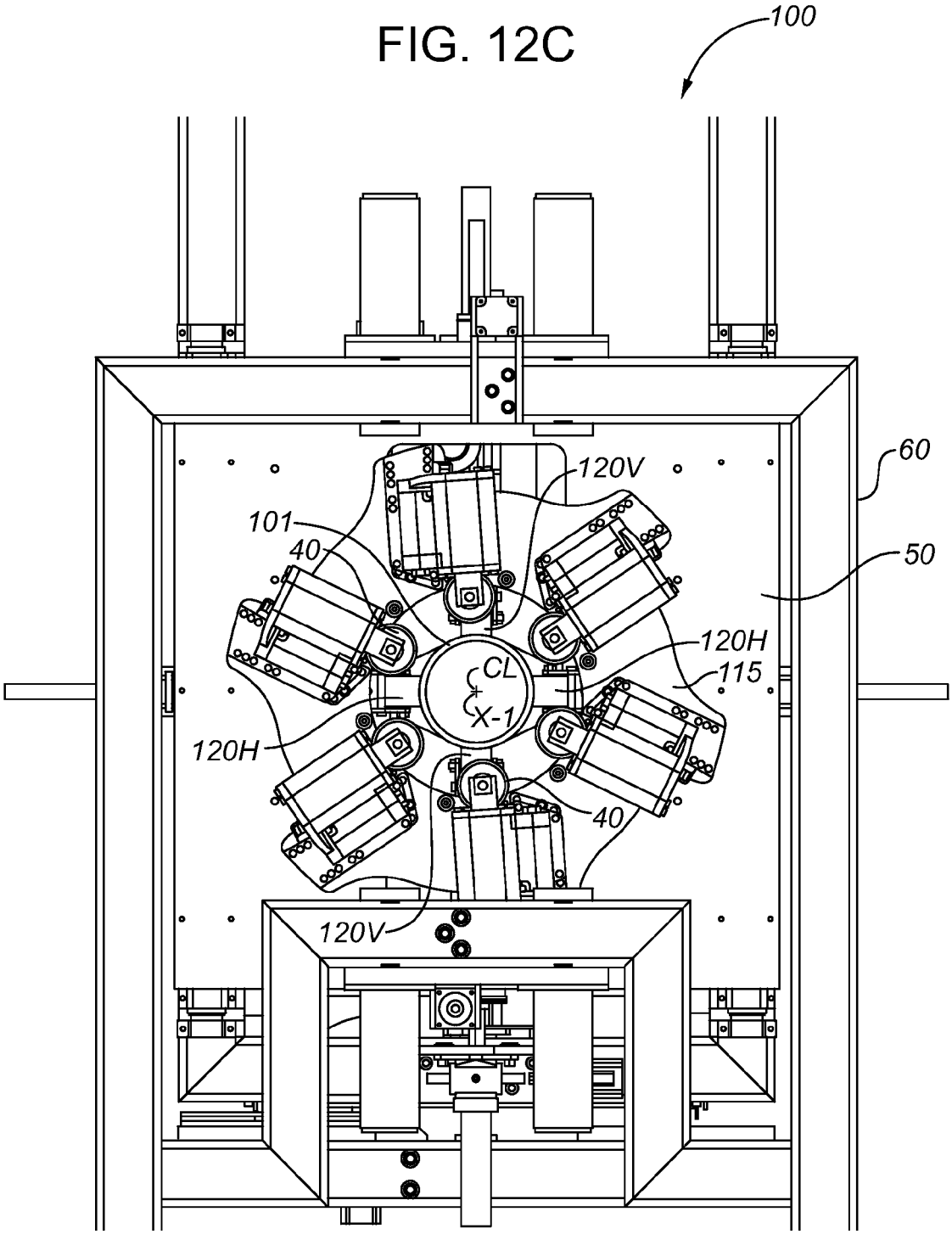
FIG. 12C is an elevation similar to FIG. 12B, but after the horizontal axis positioners have repositioned the seamer head such that the lateral position of the seamer head's rotational axis corresponds to the lateral position of the centerline of the slotted liner, such that the seamer head's rotational axis and the centerline of the slotted liner are substantially coincident as the liner passes through the seamer head.
Figure 12D:
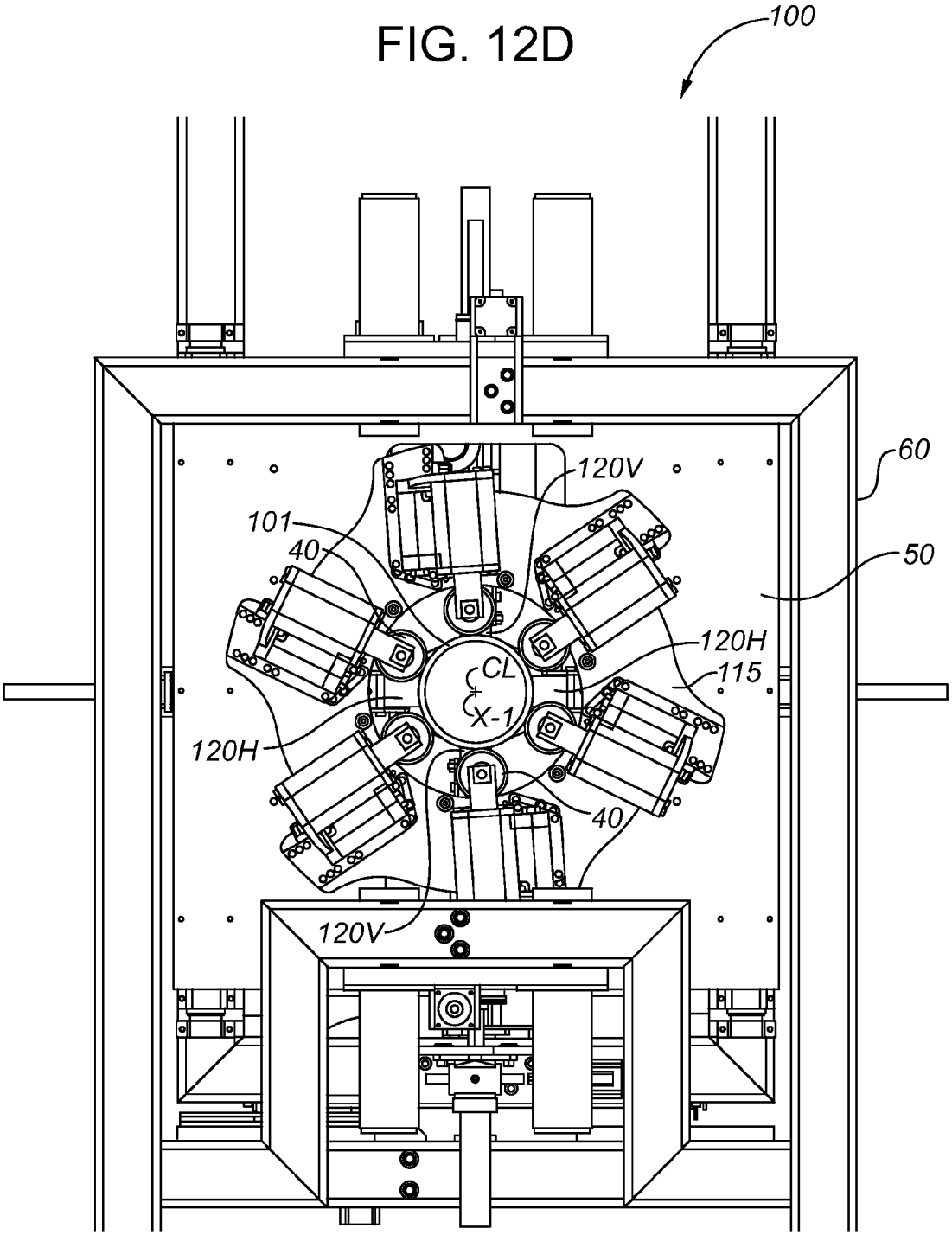
FIG. 12D is an elevation similar to FIG. 12C, but with all seaming rollers in contact with the outer surface of the slotted liner.

In FIG. 12C, the one or more horizontal axis positioners 150 have repositioned seamer head carrier 50 (and seamer head 115 in turn) such that the lateral position of rotational axis X-1 also corresponds to the lateral position of liner centerline CL. In other words, the horizontal and vertical axis positioners 150 and 160, in response to control signals from the PLC based on data from centerline probes 120H and 120V, have repositioned seamer head 115 to accommodate longitudinal bowing in slotted liner 101, such that rotational axis X-1 of seamer head 115 and liner centerline CL are substantially coincident as liner 101 passes through spindle bore 117 of seamer head 115. As a result, all seaming rollers 40 associated with seamer head 115 are now radially equidistant from liner 101, facilitating the application of equal radial forces by seaming rollers 40 against the outer surface of liner 101.

Although FIGS. 12A-12C show the positional adjustment of seamer head 115 as separate sequential steps each making comparatively large adjustments, this is for illustrative purposes only. FIGS. 12A-12C illustrate an initial set-up phase for axial alignment apparatus 100. In actual operation, apparatus 100 will be continually making positional adjustments in response to the detection of any offsets between rotational axis X-1 and liner centerline CL as slotted liner 101 passes through seamer head 115. This may be appreciated with reference to FIG. 12D, which is similar to FIG. 12C except that all seaming rollers 40 are now in contact with the cylindrical outer surface of slotted liner 101. All such positional adjustments will tend to be small after initial start-up of the apparatus, as the apparatus reacts to frequent control inputs from the PLC, such that rotational axis X-1 and liner centerline CL will remain substantially coincident as liner 101 passes through seamer head 115. Positional adjustments made by apparatus 100 typically will be made with the seaming rollers 40 in operative contact with liner 101, such the alignment process and the seaming process are carried out in concert with each other.

It is to be understood that the scope of the claims appended hereto should not be limited by the preferred embodiments described and illustrated herein, but should be given the broadest interpretation consistent with the description as a whole. It is also to be understood that the substitution of a variant of a claimed element or feature, without any substantial resultant change in functionality, will not constitute a departure from the scope of the disclosure.

In this patent document, any form of the word "comprise" is to be understood in its non-limiting sense to mean that any element following such word is included, but elements not specifically mentioned are not excluded. A reference to an element by the indefinite article "a" does not exclude the possibility that more than one of the element is present, unless the context clearly requires that there be one and only one such element.

Any use of any form of the terms "connect", "engage", "couple", "attach", "mount", or any other term describing an interaction between elements is not meant to limit the interaction to direct interaction between the subject elements, and may also include indirect interaction between the elements such as through secondary or intermediary structure. Relational or relative terms (including but not limited to "horizontal", "vertical", "parallel", "perpendicular", "concentric", and "coincident") are not intended to denote or require absolute mathematical or geometrical precision. Accordingly, such terms are to be understood as denoting or requiring substantial precision only (e.g., "substantially horizontal") unless the context clearly requires otherwise.

Wherever used in this document, the terms "typical" and "typically" are to be interpreted in the sense of representative or common usage or practice, and are not to be understood as implying invariability or essentiality.

The embodiments of the invention in which an exclusive property or privilege is claimed are defined as follows:

1. An apparatus for aligning the rotational axis of a seamer head with the centerline of a tubular member disposed within a spindle bore of the seamer head parallel to said rotational axis, said apparatus comprising:

(a) positioning means, for adjusting the spatial position of the seamer head in a direction transverse to said rotational axis;

(b) centerline sensor means, for sensing the spatial position of the tubular member's centerline where the tubular member passes through the spindle bore; and (c) control means, said control means being adapted:

c.1 to receive centerline position data from the centerline sensor means;

c.2 to determine the spatial position of the tubular member's centerline based on received centerline position data;

c.3 to compare the spatial position of the tubular member's centerline relative to the seamer head's rotational axis; and c.4 to actuate the positioning means as necessary to move the seamer head in a direction transverse to the seamer head's rotational axis so as to bring the rotational axis into substantial concentricity with the tubular member's centerline at the location of the seamer head.

2. An apparatus comprising:

(a) a base structure;

(b) a seamer head frame mounted to and horizontally movable relative to the base structure;

(c) a seamer head carrier mounted to and vertically movable relative to the seamer head frame;

(d) a seamer head mounted to the seamer head carrier, said seamer head defining a spindle bore and a rotational axis;

(e) horizontal positioning means, for adjusting the horizontal position of the seamer head frame relative to the base structure;

(f) vertical positioning means, for adjusting the vertical position of the seamer head carrier relative to the seamer head frame;

(g) a plurality of centerline measurement probes mounted in association with the seamer head carrier and adapted for contacting engagement with the cylindrical exterior surface of a tubular member disposed within the spindle bore of the seamer head;

(h) rotation means, for providing relative rotation about the rotational axis as between the tubular member and the seamer head;

(i) axial movement means, for providing relative axial movement as between the tubular member and the seamer head;

(j) a plurality of linear encoders, each linear encoder being associated with one of the centerline measurement probes and being adapted to measure the spatial position of its associated centerline measurement probe when said probe is in contact with the exterior surface of the tubular member; and (k) control means programmed:

k.1 to poll the linear encoders to determine the spatial positions of their associated centerline measurement probes;

k.2 to calculate the spatial position of the tubular member's centerline based on data polled from the encoders;

k.3 to compare the spatial position of the tubular member's centerline relative to the rotational axis; and k.4 to actuate one or more of the horizontal and vertical positioning means to move the seamer head as necessary to bring the rotational axis into substantial concentricity with the tubular member's centerline.

3. An apparatus as in claim 2 wherein the rotation means is adapted to rotate the seamer head about the rotational axis, and the axial movement means is adapted to move the tubular member axially through the spindle bore of the seamer head.

4. An apparatus as in claim 2 wherein the rotation means is adapted to rotate the seamer head about the rotational axis, and the axial movement means is adapted to move the seamer head axially relative to the tubular member disposed within the spindle bore of the seamer head.

5. An apparatus as in claim 2 wherein the axial movement means is adapted to move the tubular member axially through the spindle bore of the seamer head, and the rotation means is adapted to rotate the tubular member.

6. An apparatus as in claim 2 wherein the axial movement means is adapted to move the seamer head axially relative to the tubular member disposed within the spindle bore of the seamer head, and the rotation means is adapted to rotate the tubular member.

7. An apparatus as in claim 2 wherein at least one of the centerline measurement probes is actuated by a positioning motor in association with a linear drive assembly.

8. An apparatus as in claim 7 wherein at least one of the centerline measurement probes comprises a spring-loaded guide assembly and an associated spring-loaded follower wheel adapted for contacting engagement with the exterior surface of the tubular member disposed within the spindle bore of the seamer head.

9. An apparatus as in claim 2 wherein the control means comprises a programmable logic controller.

10. A method comprising the steps of:

(a) providing a seamer head defining a spindle bore and a rotational axis;

(b) disposing a tubular member within the spindle bore, with the centerline of the tubular member parallel to the rotational axis;

(c) determining the spatial position of the tubular member's centerline, at the spindle bore, relative to the spatial position of the rotational axis; and (d) re-positioning the seamer head as necessary to bring the rotational axis into substantial concentricity with the tubular member's centerline, at the spindle bore.

11. A method comprising the steps of:

(a) providing a seamer head defining a spindle bore and a rotational axis;

(b) providing positioning means, for adjusting the spatial position of the rotational axis, in a direct transverse thereto;

(c) disposing a tubular member within the spindle bore, with the tubular member's centerline parallel to the rotational axis;

(d) providing centerline sensor means, for sensing the spatial position of the tubular member's centerline at the spindle bore;

(e) providing control means, said control means being adapted:

e.1 to receive centerline position data from the centerline sensor means;

e.2 to determine the spatial position of the tubular member's centerline at the spindle bore, relative to the spatial position of the rotational axis, based on centerline position data received from the centerline sensor means; and e.3 to actuate the positioning means;

(f) actuating the centerline sensor means to sense the spatial position of the tubular member's centerline at the spindle bore and to send corresponding centerline position data to the control means;

(g) actuating the control means:

g.1 to determine the spatial position of the tubular member's centerline at the spindle bore, relative to the spatial position of the rotational axis; and g.2 to actuate the positioning means so as to move the seamer head transversely relative to the rotational axis as necessary to bring the rotational axis into substantial concentricity with the tubular member's centerline at the spindle bore.

12. A method as in claim 11 wherein:

(a) the seamer head is mounted to a seamer head carrier;

(b) the seamer head carrier is mounted to a seamer head frame, and is vertically movable relative to the seamer head frame; and (c) the seamer head frame is horizontally movable in a direction transverse to the rotational axis of the seamer head.

13. A method as in claim 11 wherein the positioning means comprises:

(a) one or more horizontal axis positioners, for adjusting the horizontal position of the seamer head and the rotational axis; and (b) one or more vertical axis positioners, for adjusting the vertical position of the seamer head and the rotational axis.

14. A method as in claim 13 wherein at least one of the horizontal axis positioners and at least one of the vertical axis positioners comprises actuating means selected from the group consisting of hydraulic cylinders, pneumatic cylinders, and geared mechanisms.

15. A method as in claim 11 wherein the centerline sensor means comprises a plurality of centerline measurement probes adapted for contacting engagement with the cylindrical exterior surface of the tubular member disposed within the spindle bore of the seamer head.

16. A method as in claim 15, further comprising a plurality of linear encoders associated with the centerline measurement probes.

17. A method as in claim 11, further comprising axial movement means, for providing relative axial movement as between the tubular member and the seamer head.

18. A method as in claim 11, further comprising rotation means, for providing relative rotation about the rotational axis as between the tubular member and the seamer head.

19. A method as in claim 11 wherein the control means comprises a programmable logic controller.

* * * * *